US006890417B2

(12) United States Patent
Yamashita et al.

(10) Patent No.: US 6,890,417 B2
(45) Date of Patent: May 10, 2005

(54) APPARATUS AND METHOD FOR REFINING ALKALINE SOLUTION

(75) Inventors: Tatsuro Yamashita, Kanagawa-ken (JP); Takumi Manabe, Kanagawa-ken (JP)

(73) Assignee: Tsurumi Soda Co., Ltd. (JP)

( * ) Notice: Subject to any disclaimer, the term of this patent is extended or adjusted under 35 U.S.C. 154(b) by 92 days.

(21) Appl. No.: 10/125,035

(22) Filed: Apr. 17, 2002

(65) Prior Publication Data

US 2002/0179456 A1 Dec. 5, 2002

(30) Foreign Application Priority Data

Apr. 18, 2001 (JP) ..... 2001-119994

(51) Int. Cl.[7] ..... B01D 61/44

(52) U.S. Cl. ..... 205/335; 205/537; 205/770; 204/519; 204/520; 204/630; 204/263

(58) Field of Search ..... 205/335, 537, 205/770; 204/519, 520, 263, 630

(56) References Cited

U.S. PATENT DOCUMENTS 4,532,018 A * 7/1985 Wright et al. ..... 205/335

6,682,701 B1 * 1/2004 Liu et al. ..... 422/99

* cited by examiner

*Primary Examiner*—Arun S. Phasge

(74) *Attorney, Agent, or Firm*—Andrus, Sceales, Starke & Sawall, LLP

(57) ABSTRACT

An electrolytic bath is divided into an anodic chamber and a cathodic chamber by a cation-exchange membrane. A base alkaline solution of high impurity concentration is supplied into the anodic chamber from a tank of a base material as well as a circulating anolyte overflowed from the anodic chamber is supplied and circulated from an anode circulating tank, and NaOH solution of low impurity concentration is supplied and circulated into the cathodic chamber through a tank of a refined solution. The concentration of the circulating anolyte is detected, and based on this detected value the supplying amount of the base NaOH solution is controlled and electrolysis is performed. Thus, the concentration of NaOH solution in the anodic chamber is kept stable, and the refined NaOH solution of low impurity concentration can be obtained in the cathodic chamber.

9 Claims, 3 Drawing Sheets

APPARATUS AND METHOD FOR REFINING ALKALINE SOLUTION

BACKGROUND OF THE INVENTION

This invention relates to an apparatus and a method for refining alkaline solution such as, for example, sodium hydroxide solution, potassium hydroxide solution.

Alkali chemicals have been used in steps of polishing and cleaning a wafer during a fabricating process of a silicon wafer which is a semiconductor base, and as today's industry has been highly and finely developed, NaOH solution of extremely high-purity and high concentration has been required, whose concentration is for example about 10 to 50 wt % and whose impurity concentration is for example equal to or less than about 10 ppb when sodium hydroxide solution (NaOH solution) is used as alkali chemicals.

As a conventional manufacturing method of NaOH solution, such a method is known that salt solution is fed to an anodic chamber of an electrolytic bath which is divided into the anodic chamber and a cathodic chamber by a cation-exchange membrane, and that a sodium ion passes through the cation-exchange membrane from the anodic chamber side to the cathodic chamber to proceed a generating reaction of NaOH solution in the cathodic chamber. The concentration of the NaOH solution obtained as above is at most 30 to 35 wt %, and when trying to make a solution of high concentration from this, a concentrating can for example has been used to concentrate the solution, while such a method needs a large equipment and a long processing time.

Therefore, the present inventors have studied techniques where an electrolytic bath 1 is divided into an anodic chamber 12 and a cathodic chamber 13 by a cation-exchange membrane 11 as shown in FIG. 3 for example, and a base NaOH solution of high impurity concentration is supplied to the anodic chamber 12 to perform electrolysis, whereby a refined NaOH solution of lower impurity concentration and higher concentration than the base NaOH solution is obtained in the cathodic chamber 13. In this method, a sodium ion ($Na^+$) generated in the anodic chamber 12 passes through the cation-exchange membrane 11 to the cathodic chamber 13, and whereby sodium hydroxide which is a hydroxide of sodium is generated in the cathodic chamber 13 so as to generate a sodium hydroxide solution by dissolving this sodium hydroxide in water.

There exists metal as impurities in the anodic chamber 12 at this time, but since this metal exists as an anion or precipitates as a hydroxide in alkaline atmosphere, the metal cannot pass through the cation-exchange membrane 11. Therefore, since the impurities do not get into the cathodic chamber 13, the obtained sodium hydroxide solution will be of an extremely low impurity concentration, and since $Na^+$ migrates to the cathodic chamber 13 so as to gradually increase the concentration of the NaOH solution in the cathodic chamber 13, the refined NaOH solution will be of higher concentration than the base NaOH solution.

By the way, when electrolysis is performed at a certain electric current density in the method described above, only a certain amount of ions migrates from the anodic chamber 12 to the cathodic chamber 13 through the cation-exchange membrane 11. However, it is already known that the number of $H_2O$ molecules with which NaOH is hydrated differs depending on the concentration, and whereby the number of $H_2O$ molecules with which $Na^+$ migrates from the anodic chamber 12 differs depending on the concentration of the NaOH solution in the anodic chamber 12. Therefore, when the concentration of the base NaOH solution supplied to the anodic chamber 12 changes, the concentration of the refined NaOH solution in the cathodic chamber 13 also changes.

Here, although a certain amount of the base NaOH solution is to be supplied to the anodic chamber 12 using a metering pump, the concentration of the NaOH solution in the anodic chamber 12 is not always constant, so that there exists a problem that the concentration of the refined NaOH solution is not stable.

SUMMARY OF THE INVENTION

The present invention is conceived reviewing these problems and it is an object of the invention to provide an apparatus for refining alkaline solution with which a stable refined concentration can be obtained.

It is also an object of the present invention to provide a method for refining alkaline solution with which a stable refined concentration can be obtained.

According to the present invention, an apparatus for refining alkaline solution which refines the alkaline solution using an electrolytic bath includes:

- an electrolytic bath divided into an anodic chamber and a cathodic chamber by a cation-exchange membrane,
- an electric power supply for applying voltage between an anode and a cathode respectively provided in the anodic chamber and the cathodic chamber,
- a supplying path for supplying a base alkaline solution of high impurity concentration to the anodic chamber,
- a flow volume regulator provided at the supplying path,
- a circulating path for supplying an alkaline solution of high impurity concentration overflowed from the anodic chamber again to the anodic chamber,
- a detector for detecting a concentration of the alkaline solution of high impurity concentration overflowed from the anodic chamber to circulate through the circulating path,
- a controller for controlling the flow volume regulator to increase a supplying amount of the base alkaline solution when a detected concentration value from the detector becomes lower than a predetermined set value and to decrease the supplying amount of the base alkaline solution when the detected concentration value becomes higher than the predetermined set value, and
- a means for getting out a refined solution obtained in the cathodic chamber from the cathodic chamber,
- wherein a metal cation passing through the cation-exchange membrane from the anodic chamber is made react with water in the cathodic chamber so as to obtain the refined alkaline solution with lower impurity concentration(concentration of each of impurities) and higher concentration than the base alkaline solution.

A method for refining alkaline solution is performed in this apparatus, which includes the following:

- a step of supplying a base alkaline solution of high impurity concentration to an anodic chamber in an electrolytic bath which is divided into the anodic chamber and a cathodic chamber by a cation-exchange membrane,
- a step of supplying and circulating an alkaline solution of high impurity concentration overflowed from the anodic chamber again to the anodic chamber,
- a step of detecting concentration of a circulating alkaline solution of high impurity concentration, a step of controlling a supplying amount of the base alkaline solution supplied to the anodic chamber to increase the supplying amount of the base alkaline solution when a detected concentration value from the step becomes lower than a predetermined set value and to decrease the supplying amount of the base alkaline solution when the detected concentration value becomes higher than the predetermined set value, and a step of performing electrolysis in the electrolytic bath wherein a metal cation passes through the cation-exchange membrane from the anodic chamber to the cathodic chamber, and the metal cation is made react with water in the cathodic chamber so as to obtain a refined alkaline solution of lower impurity concentration(concentration of each of impurities) and higher concentration than the base alkaline solution.

For example, when NaOH solution is refined as alkaline solution, NaOH solution of high impurity concentration is supplied to an anodic chamber, water or NaOH solution of extremely low impurity concentration, for example 20 to 35 wt % concentration is supplied to a cathodic chamber to perform electrolysis. Whereby, metallic cations, sodium ions ($Na^+$), oxide ions ($OH^-$) and metal as impurities exist in the anodic chamber. However, metal as impurities exists as an anion or precipitate as hydroxide in alkaline atmosphere. Therefore, cations in the anodic chamber are only $Na^+$, which migrate through the cation-exchange membrane to the cathodic chamber. In the cathodic chamber, sodium hydroxide which is a hydroxide of sodium is generated by electrolysis so as to generate a sodium hydroxide solution by dissolving this sodium hydroxide in water. Since the impurities do not get into the cathodic chamber, the obtained sodium hydroxide solution will be of an extremely low impurity concentration.

At this time, based on the concentration of a circulating anolyte overflowed from the anodic chamber, a supplying amount of a base NaOH solution is controlled, the concentration of NaOH solution in the anodic chamber becomes stable, and a refined NaOH solution of stable concentration can be obtained in the cathodic chamber.

When, for example, potassium hydroxide solution is refined as alkaline solution, it is preferable to perform refining with a system which includes, a first refining apparatus structured of an apparatus for refining alkaline solution according to claim 1, for example, and a second refining apparatus structured of the apparatus for refining alkaline solution according to claim 1 for example, wherein an alkaline solution of high impurity concentration after electrolysis, which is discharged from an anodic chamber of the first refining apparatus is supplied to an anodic chamber of the second refining apparatus, and according to this structure, there is an effect in that volume of waste water can be reduced since the alkaline solution of high impurity concentration after electrolysis of the first refining apparatus is used for the second refining apparatus.

Additionally, it is preferable to use a high density membrane for the cation-exchange membrane, and in this case it is possible to obtain a sodium hydroxide solution of high concentration of for example equal to or more than 45 wt %, or a potassium hydroxide solution of high concentration of for example equal to or more than 45 wt %. Furthermore, it is preferable that the electrolytic bath is made of polytetrafluoroethylene in order to reduce amount of impurities generated form the electrolytic bath.

The present invention is characterized in that when electrolysis is performed by supplying a base alkaline solution of high impurity concentration to an anodic chamber of an electrolytic bath having a cation-exchange membrane so as to obtain a refined alkaline solution of higher concentration and extremely lower impurity concentration than the base alkaline solution in a cathodic chamber, a concentration of a circulating anolyte overflowed from the anodic chamber is detected and based on this detected value a supplying amount of the base alkaline solution to the anodic chamber is controlled so as to obtain the refined alkaline solution of stable concentration.

DETAILED DESCRIPTION OF THE PREFERRED EMBODIMENTS

Figure 1:
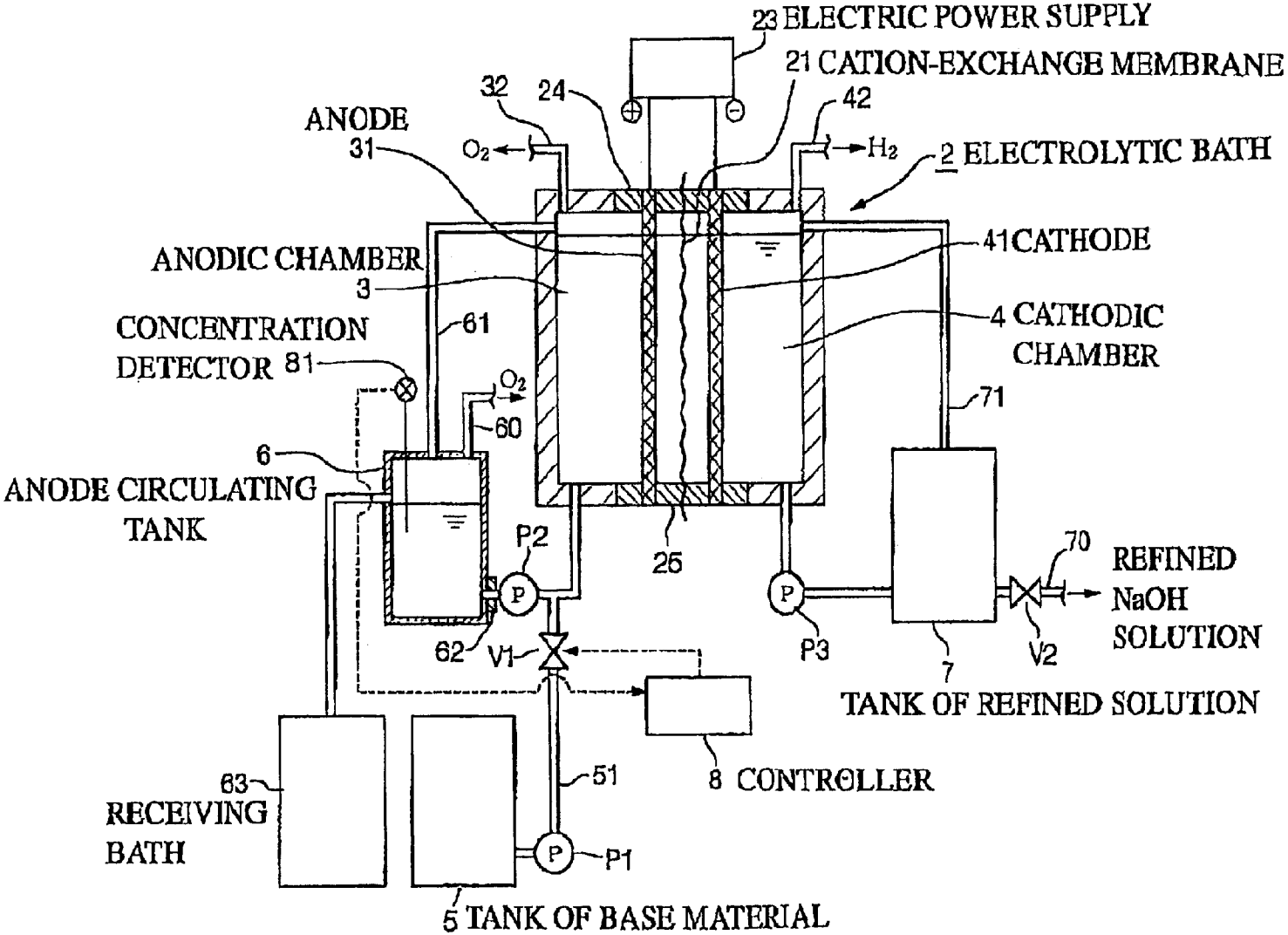
FIG. 1 is a block diagram illustrating one example of a system for refining alkaline solution according to an embodiment of the invention.
Figure 2:
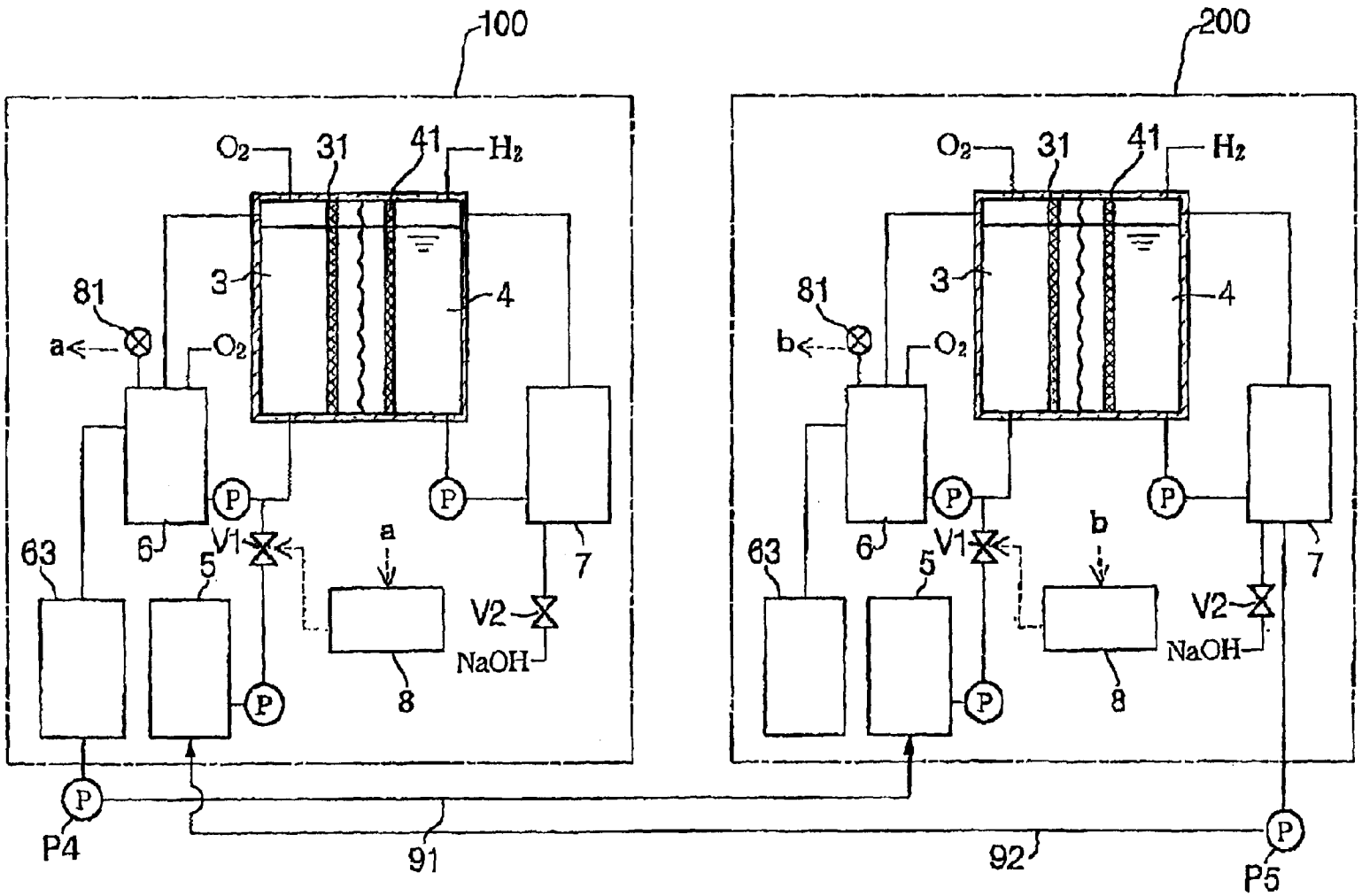
FIG. 2 is a block diagram illustrating a system for refining alkaline solution according to another embodiment of the invention.
Figure 3:
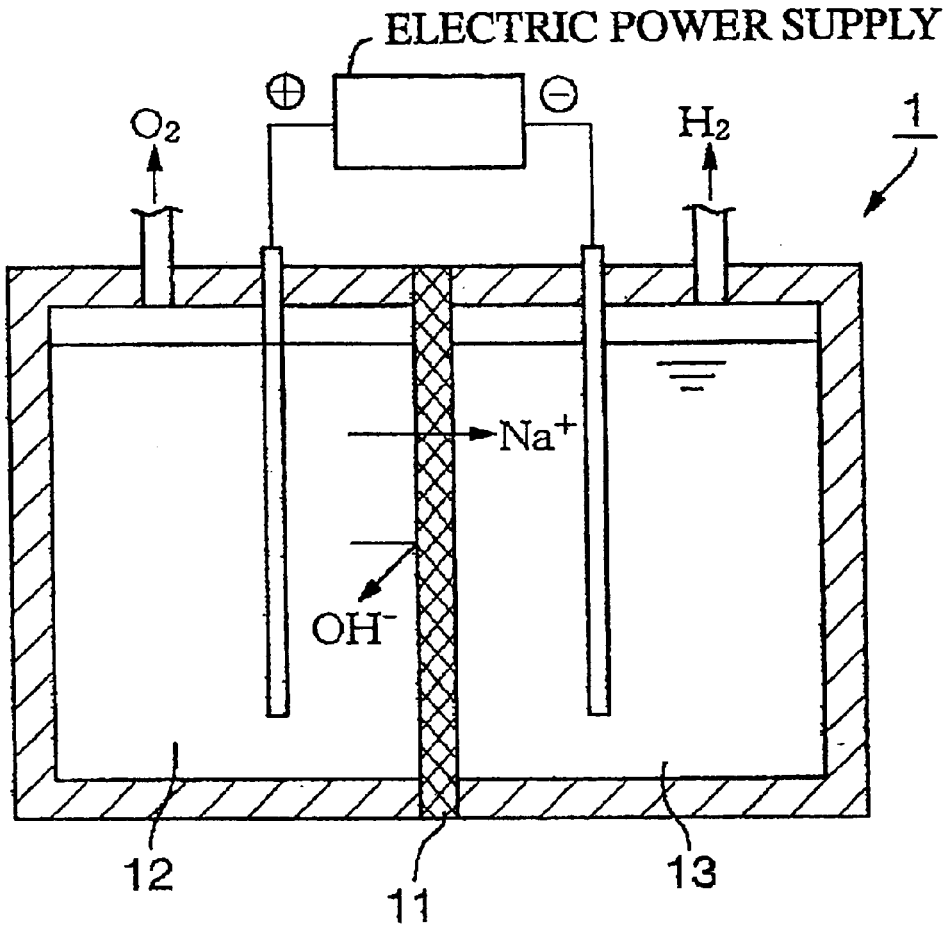
FIG. 3 (PRIOR ART)
FIG. 3 is a sectional view illustrating an electrolytic bath used in conventional alkaline solution refining.

Hereinafter, an example that sodium hydroxide solution (NaOH solution) is refined as alkaline solution will be explained according to the present invention. In FIG. 1 and FIG. 2, an electrolytic bath 2 is made of a material, which is not corroded by alkaline solution, like a resin such as, for example, polypropylene (PP), polytetrafluoroethylene (PTFE), tetrafluoroethylene perfluoro alkylvinyl ether copolymer (PFA), and the electrolytic bath 2 is divided into an anodic chamber 3 and a cathodic chamber 4 by a cation-exchange membrane 21.

For the cation-exchange membrane 21, for example a high density membrane with a brand name of "FX-151" by Asahi Glass Co., Ltd., which is a fluorine-containing cation-exchange membrane, is used, and this high density membrane can concentrate NaOH solution for example from 32 wt % to approximately 45 wt % to 60 wt %.

An anode 31 is provided in the anodic chamber 3 so as to divide the anodic chamber 3, and a cathode 41 is provided in the cathodic chamber 4 so as to divide the cathodic chamber 4. These anode 31 and cathode 41 are formed by a mesh of a conductive material such as a lath mesh, a thin plate of a conductive material with many holes punched by such as punching, or the like in order to let an anolyte and a catholyte pass through them, for example they are made of a conductive material, for example, such as nickel (Ni) which is corrosive resistant against alkaline solution of high concentration, and they are both connected to a direct-current power supply (electric power supply) 23.

Upper sides and lower sides of the cation-exchange membrane 21, the anode 31, and the cathode 41 are air-tightly fixed to the electrolytic bath 2 respectively with gaskets 24 and 25. These gaskets 24 and 25 are made of a material for example which is not corroded with alkaline solution such as natural rubber, ethylene propylene rubber (EPDM), PTFE, PFA, PP, or Gore-Tex (a registered trademark of Japan Gore-Tex, Inc.) or the like.

In thus-formed electrolytic bath 2, oxygen ($O_2$) which is generated by reaction on the anode 31 in the anodic chamber 3 described later is released through a gas release pipe 32, and hydrogen ($H_2$) which is generated by reaction on the cathode 41 in the cathodic chamber 4 described later is released through a gas release pipe 42.

In addition, in the anodic chamber 3, NaOH solution (which is referred to as a "base NaOH solution" hereinafter) which is a base material for refinement is supplied from a tank of a base material 5 made of for example low-density polyethylene (LDPE) through a supplying path 51 which includes an opening and closing valve V1 as a flow volume regulator and a metering pump P1. Furthermore, an anolyte overflowed in the anodic chamber 3 (NaOH solution in the anodic chamber 3 (which is referred to as a "circulating anolyte" hereinafter)) is supplied and circulated to the anodic chamber 3 from an anode circulating tank 6 made of for example PFA through a circulating path 61 having a metering pump P2, and a temperature regulator for regulating the anolyte at a given temperature, such as for example a heater 62 composed of a heating resistor, is provided close to a piping of outlet side of the anode circulating tank 6. $O_2$ generated in the anode circulating tank 6 is released to the outside through a gas release path 60, and the circulating anolyte overflowed in the anode circulating tank 6 is further pooled in a receiving bath 63. In an example of FIG. 1, a downstream portion side of the supplying path 51 is connected to the circulating path 61, a part of which is utilized as the supplying path 51.

On the other hand, the catholyte in the cathodic chamber 4 overflows out of the cathodic chamber 4 to be supplied and circulated to the cathodic chamber 4 from a tank of a refined solution 7 made of for example PFA through a circulating path 71 provided with a metering pump P3, and the refined NaOH solution in the tank of the refined solution 7 can be got out through a discharging path 70 by opening a valve V2. A means for getting out the refine solution is composed of the circulating path 71, the tank of the refined solution 7, and the discharging path 70.

81 in FIG. 1 is a concentration detector for detecting a concentration of the anolyte in the anode circulating tank 6, for example composed of a density meter, and based on a detected value of this detector 81 an opening extent of the valve V1 is controlled through a controller 8 in order to control an amount of the base NaOH solution supplied from the tank of the base material 5 to the anodic chamber 3. In this example, all piping materials are made of PFA, and valves made of PTFE and pumps made of PTFE are respectively utilized. Note that in the composition of FIG. 1, only the valve V1 whose opening extent is controlled and the valve V2 for obtaining the refined NaOH solution are illustrated, and other valves and the like are omitted.

Subsequently, an example of a method according to the present invention performed in the aforementioned apparatus for refining alkaline solution will be described. First of all, giving a short summary of electrolysis of NaOH solution in this apparatus, a base NaOH solution, for example a NaOH solution of about 1 ppm impurity concentration and, for example 20 to 35 wt % concentration is supplied from the tank of the base material 5 to the anodic chamber 3. In this example, a base NaOH solution of 32 wt % concentration is utilized. The circulating anolyte overflowed from the anodic chamber 3 is supplied through the anode circulating tank 6 by the metering pump P2 at a given flow volume of for example 1000 g/h. At this time in the anode circulating tank 6, temperature of the circulating anolyte overflowed from the tank 6 is regulated by the heater 62 to be kept at a given temperature, for example at temperature of around 70 degrees centigrade.

On the other hand, a 48 wt % NaOH solution of extremely low impurity concentration of for example equal to or less than 10 ppb is supplied in the cathodic chamber 4 at first, and this catholyte is supplied and circulated through the tank of the refined solution 7 by a metering pump P3 at a given flow volume of for example 1000 g/h. Thus, electrolysis is performed on a given condition, for example by passing electric current through the anode 31 and the cathode 41 at an electric current density of 30 A/dm$^2$.

By this electrolysis, NaOH solution exists in the forms of $Na^+$, $OH^-$, NaOH, and water ($H_2O$) molecule in the anodic chamber 3, out of which $Na^+$ passes through the cation-exchange membrane 21 to get into the cathodic chamber 4. On the other hand, since $OH^-$ cannot pass through the cation-exchange membrane 21, $OH^-$ exists in the anodic chamber 3 and used for electrolytic reaction proceeding in the anodic chamber 3 as shown in a following equation (1). $O_2$ gas generated in this reaction is then released through the gas release pipe 32. The water molecule passes through the cation-exchange membrane 21 together with $Na^+$ to flow downward on the surface of this exchange membrane 21 on the side of the cathodic chamber 4.

$$4\ OH^- \rightarrow 2\ H_2O + O_2 + 4e \quad (1)$$

On the other hand, an electrolytic reaction as shown in a following equation (2) proceeds in the cathodic chamber 4 so as to generate NaOH by this reaction. The NaOH generated in this way is then dissolved into water of the 48 wt % NaOH solution of extremely low impurity concentration which is supplied to the cathodic chamber 4. As the electrolysis proceeds like this, the concentration of the NaOH solution in the cathodic chamber 4 gradually becomes higher, and a NaOH solution of higher concentration than the base NaOH solution, for example equal to or more than 45 wt % NaOH solution, is generated in the cathodic chamber 4. Hydrogen ($H_2$) gas generated in this electrolytic reaction is then released through the gas release pipe 42.

$$4\ Na^+ + 4\ H_2O + 4e \rightarrow 2\ H_2 + 4\ NaOH \quad (2)$$

Here, a 32 wt % NaOH solution, for example obtained by the electrolysis of salt water which is explained in the description of the related art, is used for the base NaOH solution, and although impurities of about 1 ppm such as Fe, Ni, Mg, or Ca are included in this NaOH solution, metal as impurities such as Fe, Ni, Mg, or Ca exist in the forms of an anion or a hydroxide in this anodic chamber 3 since the anodic chamber 3 is filled with NaOH solution and is alkaline. For example in the case of Fe, Fe exists in the NaOH solution in the forms of HFe $O^{2-}$ or $FeO_4^{2-}$, or precipitates as $Fe(OH)_2$, or $Fe(OH)_3$ in alkaline atmosphere. Therefore, these impurities cannot pass through the cation-exchange membrane 21, are retained in the anodic chamber 3 and accordingly cannot get into the cathodic chamber 4, so that NaOH solution of equal to or more than 45 wt % concentration and equal to or less than 10 ppb impurity concentration will be generated in the cathodic chamber 4.

At this time, as $Na^+$ migrates to the cathodic chamber 4 by the electrolytic reaction in the anodic chamber 3, concentration of the circulating anolyte overflowed from the anodic chamber 3 to the circulating path 61 and the returned anolyte overflowed from the anode circulating tank 6 is lower than that of the base NaOH solution, and is, for example, approximately between 15 wt % and 18 wt %.

Next, a method of the present invention will be described. The method according to the present invention is to manage the concentration of the refined NaOH solution obtained in the cathodic chamber 4 by the concentration of the NaOH solution in the anodic chamber 3.

When an electric current density is constant just as described above, an amount of cations which migrate from the anodic chamber 3 to the cathodic chamber 4 is constant, so that a migrating amount of the cations is determined by the electric current density and the electrolytic time. Additionally, an amount of NaOH generated in the cathodic chamber 4 is also determined by the electric current density and the electrolytic time. Therefore, when obtaining NaOH solution of a given concentration by the aforementioned electrolysis, electrolytic condition is determined by a concentration of the NaOH solution supplied to the anodic chamber 3, a concentration of the NaOH solution supplied before the electrolysis to cathodic chamber 4, the electric current density, the electrolytic time, and when ultrapure water is flown into the cathodic chamber 4, electrolytic condition is determined by a flow volume of ultrapure water. In this case, the electrolytic time means a detention period of the anolyte in the anodic chamber 3 and a detention period of the catholyte in the cathodic chamber 4, which are controlled by a supplying flow volume of the NaOH solution to the anodic chamber 3, a circulating flow volume of the catholyte to the cathodic chamber 4, and timing of opening and closing of the valve V2.

In such a method, it is important to keep the migrating amount of the cations stable in order to obtain NaOH solution of stable concentration, therefore it is also important to control the concentration of the NaOH solution supplied to the anodic chamber 3. In other words, since the number of $H_2O$ molecules with which $Na^+$ migrates is different depending on the concentration of the NaOH solution in the anodic chamber 3 as described above even though the electric current density is kept constant, when the concentration of the NaOH solution in the anodic chamber 3 is high, the concentration of the refined NaOH solution will be also high as a result. On the other hand, when the concentration of the NaOH solution in the anodic chamber 3 is low, the concentration of the refined NaOH solution will be also low as a result. In this way, when the amount of the migrating cations is not stable, the concentration of the refined NaOH solution will be varied as a result despite the same electrolytic condition. One of elements to decide the concentration of the NaOH solution supplied to the anode chamber 3 is a detention period, and the detention period is controlled by a flow volume of the NaOH solution to the anode chamber 3.

By the way, when electrolysis is performed at a given electric current density in the anodic chamber 3, only a given amount of ions out of $Na^+$ in the anodic chamber 3 migrates to the cathodic chamber 4, whereby in the case that the supplying amount of the base NaOH solution is constant, as the concentration of the NaOH solution supplied to the anodic chamber 3 becomes higher, the concentration of the circulating anolyte overflowed from the anodic chamber 3 becomes higher, while in the case that the concentration of the base NaOH solution is constant, as the supplying amount of the NaOH solution supplied to the anodic chamber 3 becomes larger, the concentration of the circulating anolyte overflowed from the anodic chamber 3 becomes also higher.

Here, assuming that the supplying amounts of the circulating anolyte and the base NaOH solution to the anodic chamber 3 are constant, as the concentration of the circulating anolyte becomes higher, the concentration of the NaOH solution in the anodic chamber 3 becomes higher. Since the concentration of the NaOH solution in the anodic chamber 3 differs like this, the concentration of the NaOH solution obtained in the cathodic chamber 4 also differs as described above, so that it is important to keep the concentration of the NaOH solution in the anodic chamber 3 stable in order to obtain the stable NaOH solution in the cathodic chamber 4 constantly, for which the concentration of the refined NaOH solution obtained in the cathodic chamber 4 is managed by the concentration of the NaOH solution in the anodic chamber 3.

Specifically, the concentration of the circulating anolyte overflowed from the anodic chamber 3 to the circulating path 61 is detected, and based on this detected value the supplying amount of the base NaOH solution to the anodic chamber 3 is controlled, that is in this example, the concentration of the circulating anolyte in the anode circulating tank 6 is detected regularly by a concentration detector 81, and based on this detected value the opening extent of the opening and closing valve V1 is controlled by the controller 8 to regulate the supplying amount of the base NaOH solution which is supplied from the tank of the base material 5 to the anodic chamber 3. At this time, the circulating anolyte in the anode circulating tank 6 is supplied and circulated to the anodic chamber 3 by the metering pump P2 at a given flow, for example at 1000 g/h, and the catholyte in the tank of the refined solution 7 is also supplied and circulated to the cathodic chamber 4 by the metering pump P3 at a given flow, for example at 1000 g/h. Additionally, a flow volume of the circulating anolyte overflowed from the anode circulating tank 6 to the first the receiving bath 63 (which is referred to as a "returned anolyte" hereinafter) is for example at 65 g/h approximately.

As for controlling of the supplying amount of the base NaOH solution, when the concentration of the circulating anolyte is lower than the predetermined set value for example, it means that the concentration of the NaOH solution in the anodic chamber 3 is lower than a given concentration, so that the concentration of the NaOH solution in the anodic chamber 3 is regulated to become higher up to the given concentration by opening the opening and closing valve V1 to increase the supplying amount of the base NaOH solution of higher concentration than the circulating anolyte. On the other hand, when the concentration of the circulating anolyte is higher than the predetermined set value for example, it means that the concentration of NaOH solution in the anodic chamber 3 is higher than the given concentration, so that the concentration of the NaOH solution in the anodic chamber 3 is regulated to be lower down to the given concentration by closing the opening and closing valve V1 to decrease the supplying amount of the base NaOH solution of higher concentration than the circulating anolyte (or to let the supplying amount zero in some cases). When regulating the concentration, since the concentration of the circulating anolyte is already known and the circulating anolyte is supplied at a given amount, for example at a flow volume of 1000 g/h, by the metering pump P2, it is possible to regulate the concentration of the anolyte in the anodic chamber 3 by regulating the supplying amount of the 32 wt % base NaOH solution.

The NaOH solution in the anodic chamber 3 and the NaOH solution in the cathodic chamber 4 are respectively supplied and circulated like this, and while controlling the supplying amount of the base NaOH solution based on the concentration of the circulating anolyte, electrolysis is performed for a given period by supplying electric current at the electric current density of 30 $A/dm^2$ to the anode 31 and the cathode 41. Thus, the NaOH solution in the cathodic chamber 4 is concentrated to a given concentration of for example equal to or more than 45 wt %, for example to a concentration of 48 to 50 wt %, and by opening the valve V2 thereafter, the refined NaOH solution of high concentrations obtained, which is of extremely low impurity concentration and of equal to or more than 45 wt % concentration. On the other hand, the returned anolyte overflowed from the anode circulating tank 6 to the receiving bath 63 will be discarded or collected to be recycled.

In the method described above, a sodium hydroxide solution of a desired concentration can be obtained by controlling the generating amount of $Na^+$ by regulating the concentration and the supplying amount of the base NaOH solution supplied to the anodic chamber 3 and the anolyte, the electric current density, and the electrolytic time, as well as by controlling the concentration of the NaOH solution of extremely low impurity concentration supplied to the cathodic chamber 4, the amount of the water migrated from the anodic chamber 3 to the cathodic chamber 4, the detention period of the catholyte in the cathodic chamber 4, and the flow volume when ultrapure water is flown to the cathodic chamber 4.

Here, by using for example a high density membrane with a brand name of "FX-151" by Asahi Glass Co., Ltd. for the cation-exchange membrane 21, a 32 wt % NaOH solution can be concentrated up to approximately 45 wt % to 60 wt % in the cathodic chamber 4, since this membrane realizes electrolysis with high current efficiency due to a multi-layered structure of an ion-exchange layer and a porous layer, and electrolysis without degration at low voltage.

Additionally, in order to operate it stably, it is preferable that the electric current density is set to be at approximately 30 $A/dm^2$ and that the concentration of the circulating anolyte is set to be in the range from 15 to 18 wt % as for the electrolytic condition, because in a case of a larger electric current density where the amount of $Na^+$ migrated to the cathodic chamber 4 is surely increased, lifetime of the cation-exchange membrane 21 will be shortened by increased load thereof, temperature and voltage in the electrolytic bath 2 will tend to be raised, and furthermore control is difficult since the concentration of the NaOH solution obtained in the cathodic chamber 4 will be immediately reflected by changes in the concentration and the flow volume of the base NaOH solution.

Furthermore, in the above example, since the circulating anolyte overflowed from the anodic chamber 3 is supplied and circulated again to anodic chamber 3 through the anode circulate tank 6, it is possible to reduce a using amount of the base NaOH solution and to improve efficiency thereof. In other words, the circulating anolyte overflowed from the anodic chamber 3 is of lower concentration than the base NaOH solution but still includes $Na^+$. Although this circulating anolyte includes impurities, the impurities in the anodic chamber 3 do not migrate to the cathodic chamber 4 in the method according to the present invention as described above.

Therefore, the aforementioned circulating anolyte can be recycled, and furthermore, it can be concentrated to equal to or more than 45 wt % by the aforementioned method so as to obtain the NaOH solution of high concentration as it is obvious from experiment examples as described later, since the anolyte is mixed with for example the 32 wt % base NaOH solution in the anodic chamber 3 in spite that the concentration of the anolyte is lower than that of the base NaOH solution.

In this way, by supplying and circulating the circulating anolyte overflowed from the anodic chamber 3 to the anodic chamber 3, an amount of the NaOH solution which is discharged out of the system will be approximately one-tenth, and an amount of the base NaOH solution will be one-third of those shown in the experiment examples as described later, whereby the yield of obtaining the refined NaOH solution from the base NaOH solution will be improved from 27 wt % to 80 wt % as compared with a case without supplying and circulating.

Moreover, in the above example, since the supplying amount of the base NaOH solution to the anodic chamber 3 is controlled based on the concentration of the circulating anolyte overflowed from the anodic chamber 3, the concentration of the NaOH solution in the anodic chamber 3 is kept stable, whereby the NaOH solution of stable high concentration can be obtained. Here, the concentration of the circulating anolyte may be detected not only in the anode circulating tank 6 but also within the circulating path 61 at any time.

On the other hand, when the supplying amount of the base NaOH solution to the anodic chamber 3 is not controlled, it is still possible to obtain the NaOH solution of equal to or more than 45 wt % concentration by supplying the base NaOH solution and the circulating anolyte at a given flow volume by a metering pump by narrowing the electrolytic condition, though it is difficult to obtain the refined NaOH solution of stable concentration.

Additionally, the temperature regulator is provided in the anode circulating tank 6 to regulate temperature of the circulating anolyte, and this circulating anolyte is supplied to the anodic chamber 3, whereby temperature of the NaOH solution in the anodic chamber 3 and temperature of NaOH solution in the cathodic chamber 4 which is adjacent to this NaOH solution can be regulated. Therefore, temperature of the solution in the electrolytic bath 2 can be managed and electrolytic reaction can be performed in a stable condition, so that the refined NaOH solution of stabler concentration can be obtained. While it is effective to regulate temperature of the circulating anolyte like this, the apparatus may take a structure without a temperature regulator since the refined NaOH solution of stable concentration can be obtained without managing temperature like this, as well as the apparatus may take a structure with a temperature regulator in other portion as long as temperature of the solution in the electrolytic bath can be regulated.

Additionally, though impurities dissolved from the electrolytic bath etc. should be considered in addition to impurities originally included in the base NaOH solution in this invention, corrosion by the alkaline solution is held down and impurities dissolved from the electrolytic bath 2 etc. are decreased extremely, since the electrolytic bath is made of PP, PTFE, or PFA, and a gasket is made of natural rubber, EPDM, PP, PTFE, PFA, Gore-Tex (a registered trademark of Japan Gore-Tex, Inc.), or the like in the aforementioned example. Here, since the impurities dissolved in the anodic chamber 3 remain in the forms of an anion or a hydroxide in the anodic chamber 3 as described above, the impurities which are included in the NaOH solution after refining is only the one dissolved in the cathodic chamber 4. Therefore, dissolving amount in the cathodic chamber 4 will be decreased substantially. In this point, impurity concentration will be low. Furthermore, since tanks, piping materials, valves, pumps other than the electrolytic bath 2 are made of a material which is corrosive resistant against alkaline solution, an amount of impurities dissolved from them will be extremely reduced in the above example.

While the anode 31 and the cathode 41 are made of for example Ni in the above example, Ni is not corroded in NaOH solution, and assuming the possibility that oxide film on the metal surface comes off, Ni oxide generated on the anode 31 cannot pass through the cation-exchange membrane 21 and oxidation is held down because of cathodic polarization occurred by electricity at the cathode 41, whereby there is no worry that the surface oxide comes off and there is no problem to cause impurities. Note that it is not limited to NaOH solution to be used for the alkaline solution to which the present invention is applied, but that KOH solution may be used.

According to the present invention as described above, the aforementioned apparatus for refining alkaline solution can be coupled in multistage as shown in FIG. 2. In this case, a first refining apparatus 100 and a second refining apparatus 200 are respectively structured for example similarly to the apparatus for refining alkaline solution as described above, and a returned alkaline solution stored in a receiving bath 63 of the first refining apparatus 100 is supplied to a tank of the base material 5 of the second refining apparatus 200 through a supplying path 91 by a metering pump P4.

Such a system for refining alkaline solution is effective when the returned alkaline solution discharged from the receiving bath 63 cannot be collected and will be discarded, and the system is suited to refine potassium hydroxide (KOH solution) for example. In this case, KOH solution is refined by the same method as the apparatus for refining alkaline solution as illustrated in FIG. 1 except that the returned KOH solution in the receiving bath 63 in the first refining apparatus 100 is supplied to the second refining apparatus 200, whereby the refined KOH solution of for example equal to or more than 45 wt % concentration and of impurity concentration of equal to or less than 10 ppb can be obtained.

Additionally, since the returned KOH solution generated in the first refining apparatus 100 is supplied to the tank of the base material 5 in the second refining apparatus 200, KOH solution is refined in the same method as the aforementioned embodiment except that a volume of the returned KOH solution of the first refining apparatus 100, which is supplied to an anodic chamber 3 through a tank of the base material 5, is controlled based on the concentration of the circulating anolyte overflowed from the anodic chamber 3. Incidentally, since the concentration is considerably low and the amount is relatively little in the returned KOH solution overflowed from the anode circulating tank 6 of the second refining apparatus 200, it is easy to discard the returned KOH solution.

In this second refining apparatus 200, since concentration of the KOH solution in the anodic chamber becomes lower than that of the first refining apparatus, the concentration of the refined KOH solution obtained in a cathodic chamber 4 will be for example 25 wt %, which is lower than that of the refined KOH solution obtained in the first refining apparatus. Therefore, the refined KOH solution obtained in the second refining apparatus may be utilized as a product, but the refined alkaline solution in a tank of the refined solution 7 of the second refining apparatus 200 may be supplied to the tank of the base material 5 of the first refining apparatus 100 through a supplying path 92 by a metering pump P5.

Thus, the returned alkaline solution will be utilized effectively by coupling the refining apparatuses, so that an amount of waste alkaline solution can be reduced, yield thereof can be improved, and in addition, the refined alkaline solution of different concentrations can be obtained. Since volume of waste water of the returned KOH solution can be reduced more in such a structure that refining apparatuses are coupled to each other, the apparatus is suited to refine KOH solution.

As described above, the present invention can be applied to refining soluble alkaline hydroxide of alkali metals or alkaline-earth metals, such as sodium hydroxide solution, potassium hydroxide solution, barium hydroxide solution, lithium hydroxide solution, or cesium hydroxide solution.

Additionally, the high density membrane need not to be used as a cation-exchange membrane in the aforementioned refining apparatus, and in this case, though the concentration of the obtained alkaline solution is equal to or less than 45 wt %, the refined alkaline solution of higher concentration than the base alkaline solution and of extremely low impurity concentration of for example equal to or less than 10 ppb can be obtained.

Furthermore, in the present invention a massflow controller may be utilized as a flow volume regulator, and the concentration of the circulating anolyte overflowed from the anodic chamber may be detected to control the supplying amount of the circulating anolyte in addition to that of the base NaOH solution. The concentration of the circulating anolyte overflowed from the anodic chamber may be detected in the circulating path.

Furthermore, in the present invention, the apparatus may take a structure that the catholyte is not circulated to the cathodic chamber, but if the catholyte is circulated, it is effective in that voltage can be dropped in order to prevent gas adhesion to a surface of the cation-exchange membrane. Moreover, as NaOH generated by the electrolytic reaction should be dissolved into water in the cathodic chamber, water of extremely low impurity concentration such as for example ultrapure water may be supplied before the electrolysis, or water migrated from the anodic chamber may be used to obtain NaOH solution while supplying nothing to the cathodic chamber in advance.

EXAMPLE

Example 1

While feeding the base NaOH solution of 32 wt % concentration and of 1 ppm impurity concentration into the anodic chamber 3 of the electrolytic bath 2 by the tank of the base material 5 as shown in the aforementioned FIG. 1, the circulating anolyte overflowed from the anodic chamber 3 is supplied and circulated from the anode circulating tank 6 at 1000 g/h flow, and NaOH solution of 48 wt % concentration and of equal to or less than 10 ppb impurity concentration is supplied and circulated to the cathodic chamber 4 through the tank of the refined solution 7 at 1000 g/h flow, where while keeping the returned anolyte overflowed from the anode circulating tank 6 at 65 g/h flow, current of 30 A/dm$^2$ electric current density is passed to the anode 31 and the cathode 41, and then, the concentration of the circulating anolyte is detected and based on this detected value electrolysis is performed by controlling the supplying amount of the base NaOH solution from the tank of the base material 5, where the concentration of the refined NaOH solution in the cathodic chamber 3 is measured regularly by titration with hydrochloric acid after a given period and the impurity concentration of the refined NaOH solution is further analyzed by ICP AES (inductively coupled plasma emission spectrophotometer).

Here, the electrolytic bath and the gaskets are made of PTFE, and the anode 31 and the cathode 41 are composed of lath mesh made of Ni. A membrane with a brand name of "FX-151" by Asahi Glass Co., Ltd. is used for the cation-exchange membrane, with effective electrolysis dimension of 1 dm$^2$ of 10 cm×10 cm. In addition, the temperature of the circulating anolyte is regulated approximately at 70 degrees centigrade by the temperature regulator.

The concentration of the refined NaOH solution obtained by this electrolysis is equal to or more than 48 wt % and is stable, the span of adjustable flow range of the base NaOH solution is (150±15) g/h and (±10 wt %), and the concentration of the circulating anolyte is around 16.5 wt %. Furthermore, in examining the impurity concentration, whose results are shown in table 1, the impurity concentration is recognized to be equal to or less than 10 ppb.

TABLE 1

| | Impurity concentration (ppb) | |
|---|---|---|
| Impurity | Example 1 | Comparative example 1 |
| Ca | 1.5 | 4.0 |
| Fe | 10 | 2.7 |
| Na | equal to or less than 4.0 | equal to or less than 4.0 |
| Al | 2.6 | 3.3 |
| Zn | 6.7 | 4.5 |

Comparative Example 1

While keeping the supplying amount of the base NaOH solution at 150 g/h, electrolysis is performed on the same condition as the Example 1 except that the flow volume of the base NaOH solution is not controlled, and after a given period a concentration and an impurity concentration is detected regularly for the refined NaOH solution in the cathodic chamber 4.

The concentration of the refined NaOH solution obtained by this electrolysis in the cathodic chamber 4 is 45.2 wt % when 3 hours pass after passing electric current, 52.8 wt % when 1 day passes after passing electric current, and 48.5 wt % when 3 days pass after passing electric current. Although the refined NaOH solution of equal to or more than 45 wt % concentration and of equal to or less than 10 ppb impurity concentration solution can be obtained as described above, the concentration of the refined NaOH solution is not stable in the range from 40 wt % to 60 wt %.

Comparative Example 2

While keeping the supplying amount of the base NaOH solution at 150 g/h, and keeping the supplying amount of the NaOH solution of extremely low impurity concentration to the cathodic chamber at 1000 g/h, electrolysis is performed on the same condition as the Example 1 except that the anolyte and the catholyte are not supplied and circulated and that the flow volume of the base NaOH solution is not controlled, and after a given period a concentration and an impurity concentration are detected regularly for the refined NaOH solution in the cathodic chamber 4, where the concentration of the refined NaOH solution obtained by this electrolysis is equal to or more than 45 wt % and the impurity concentration thereof is equal to or less than 10 ppb.

By comparing the Example 1 and the comparative example 2, it is recognized that the refined NaOH solution of equal to or equal to or less than 10 ppb impurity concentration can be obtained when supplying and circulating the circulating anolyte almost similarly to a case of not supplying and circulating the circulating anolyte, and that impurities in the base NaOH solution can be eliminated even when supplying and circulating the circulating anolyte. Additionally, in these experiments, when supplying and circulating the circulating anolyte, the using amount of the base NaOH solution becomes approximately one-third and the using amount of the returned NaOH solution becomes approximately one-tenth as compared with a case of not supplying and circulating the circulating anolyte, whereby it is recognized that the base NaOH solution is utilized effectively and the yield thereof is improved from approximately 27 wt % to approximately 80 wt %.

Additionally, by comparing the Example 1 and the comparative example 1, it is recognized that the concentration of the refined NaOH solution obtained in the cathodic chamber will be stable by controlling the supplying amount of the base NaOH solution based on the concentration of the circulating anolyte. Thus, according to the present invention, it is possible to construct a system where NaOH solution of equal to or more than 45 wt % concentration and of equal to or less than 10 ppb impurity concentration is produced commercially.

In the electrolytic bath which is divided into the anodic chamber and the cathodic chamber by the cation-exchange membrane, when the base alkaline solution of high impurity concentration is supplied to the anodic chamber and electrolysis is performed so as to obtain the refined alkaline solution of higher concentration than the base alkaline solution and of extremely low impurity concentration in the cathodic chamber, it is possible to obtain the refined alkaline solution of the stable concentration in the cathodic chamber by detecting the concentration of the alkaline solution of high impurity concentration overflowed from the anodic chamber and by controlling the supplying amount of the base alkaline solution based on this detected value.

What is claimed is:

1. An apparatus for refining alkaline solution to refine the alkaline solution using an electrolytic bath, comprising:

an electrolytic bath divided into an anodic chamber and a cathodic chamber by a cation-exchange membrane, an electric power supply for applying voltage between an anode and a cathode respectively provided in the anodic chamber and the cathodic chamber, a supplying path for supplying a base alkaline solution of high impurity concentration to the anodic chamber, a flow volume regulator provided at the supplying path, a circulating path for supplying the alkaline solution of high impurity concentration to the anodic chamber, a flow volume regulator provided at the supplying path, a circulating path for supplying the alkaline solution of high impurity concentration overflowed from the anodic chamber to circulate through the circulating path, a controller for controlling the flow volume regulator to increase a supplying amount of the base alkaline solution when a detected concentration value from the detector become lower than a predetermined set value and to decrease the supplying amount of the base alkaline solution when the detected concentration value becomes higher than the predetermined set value, a circulating path for circulating a refined alkaline solution overflowed from the cathodic chamber again to the cathodic chamber, a tank of the refined solution provided in the circulating path for circulating the refined alkaline solution and a means for getting out the refined alkaline solution from the tank of the refined solution and wherein a metal cation passing through the cation-exchange membrane from the anodic chamber is made to react with water of the refined alkaline solution in the cathodic chamber to obtain the refined alkaline solution of lower impurity concentration and higher concentration than the base alkaline solution.

2. The apparatus for refining alkaline solution defined in claim 1, wherein a circulating tank is provided in the circulating path for supplying the alkaline solution of high impurity concentration overflowed from the anodic chamber again to the anodic chamber.

3. The apparatus for refining alkaline solution defined in claim 1, wherein a discharging path for discharging oxygen gas generated in the anodic chamber is provided in the anodic chamber, and a discharging path for discharging hydrogen gas generated in the cathodic chamber is provided in the cathodic chamber.

4. The apparatus for refining alkaline solution defined in claim 1, wherein the alkaline solution is a sodium hydroxide solution or a potassium hydroxide solution.

5. The apparatus for refining alkaline solution defined in claim 1, wherein the base alkaline solution of high impurity concentration is a 20 to 35 wt % sodium hydroxide solution, and the refined alkaline solution is a equal to or more than 45 wt % sodium hydroxide solution.

6. The apparatus for refining alkaline solution defined in claim 1, wherein the refined alkaline solution is an alkaline solution including equal to or less than 10 ppb metal except alkali metals and alkaline-earth metals.

7. An apparatus for refining alkaline solution, comprising: a first refining apparatus structured of an apparatus for refining alkaline solution defined in claim 1, a second refining apparatus structured of the apparatus for refining alkaline solution defined in claim 1, and a means for supplying the alkaline solution of high impurity concentration discharged from an anodic chamber of the first refining apparatus after electrolysis to an anodic chamber of the second refining apparatus.

8. The apparatus for refining alkaline solution defined in claim 7, further comprising, a means for supplying a refined alkaline solution discharged from a cathodic chamber of the second refining apparatus to the anodic chamber of the first refining apparatus through the supplying path as a base alkaline solution.

9. A method for refining alkaline solution to refine the alkaline solution using an electrolytic bath, comprising:

a step of supplying a base alkaline solution of high impurity concentration to an anodic chamber in the electrolytic bath which is divided into the anodic chamber and a cathodic chamber by a cation-exchange membrane, a step of supplying and circulating an alkaline solution of high impurity concentration overflowed from the anodic chamber again to the anodic chamber, a step of detecting concentration of the circulating alkaline solution of high impurity concentration, a step of controlling a supplying amount of the base alkaline solution supplied to the anodic chamber to increase the supplying amount of the base alkaline solution when a detected concentration value from the step of detecting concentration becomes lower than a predetermined set value and to decrease the supplying amount of the base alkaline solution when the detected concentration value becomes higher than the predetermined set value, and a step of performing electrolysis in the electrolytic bath, a step of circulating a refined alkaline solution overflowed from the cathodic chamber passing through the tank of the refined alkaline solution again to the cathodic chamber, and a step of getting out the refined alkaline solution from the tank of the refined alkaline solution, wherein a metal cation passes through the cation-exchange membrane from the anodic chamber to the cathodic chamber, and the metal cation is made to react with water of the refined alkaline solution in the cathodic chamber so that a refined alkaline solution of lower impurity concentration and higher concentration than the base alkaline solution is generated.

* * * * *